US009671758B2

(12) United States Patent
Wu

(10) Patent No.: US 9,671,758 B2
(45) Date of Patent: Jun. 6, 2017

(54) QUARTZ WATCH MOVEMENT

(71) Applicant: Zhongyi Wu, Shenzhen (CN)

(72) Inventor: Zhongyi Wu, Shenzhen (CN)

( * ) Notice: Subject to any disclaimer, the term of this patent is extended or adjusted under 35 U.S.C. 154(b) by 0 days.

(21) Appl. No.: 14/761,302

(22) PCT Filed: Feb. 13, 2014

(86) PCT No.: PCT/CN2014/072031

§ 371 (c)(1),
(2) Date: Jul. 15, 2015

(87) PCT Pub. No.: WO2014/127706

PCT Pub. Date: Aug. 28, 2014

(65) Prior Publication Data

US 2015/0355602 A1 Dec. 10, 2015

(30) Foreign Application Priority Data

Feb. 23, 2013 (CN) ..... 2013 1 0058294
Mar. 14, 2013 (CN) ..... 2013 1 0081052
Nov. 13, 2013 (CN) ..... 2013 2 0717985

(51) Int. Cl.

| | |
|---|---|
| ***G04B 13/02*** | (2006.01) |
| ***G04B 27/00*** | (2006.01) |
| ***G04B 27/02*** | (2006.01) |
| ***G04C 3/00*** | (2006.01) |

(52) U.S. Cl.

CPC ..... *G04B 27/02* (2013.01); *G04B 13/02* (2013.01); *G04B 13/021* (2013.01); *G04B 27/004* (2013.01); *G04C 3/001* (2013.01)

(58) Field of Classification Search

CPC . G04C 9/00; G04C 9/06; G04C 3/001; G04B 27/00; G04B 27/004; G04B 27/02; G04B 13/02; G04B 13/021

See application file for complete search history.

(56) References Cited

U.S. PATENT DOCUMENTS 4,351,040 A * 9/1982 Aoki ..... G04C 3/008 368/220
4,910,721 A * 3/1990 Hayakawa ..... G04C 9/00 368/149
5,016,231 A * 5/1991 Kawaguchi ..... G04C 9/00 368/187

(Continued)

*Primary Examiner* — Vit W Miska
(74) *Attorney, Agent, or Firm* — Raymond Y. Chan; David and Raymond Patent Firm

(57) ABSTRACT

A quartz watch movement includes a minute wheel connected to a handsetting wheel by an intermediate wheel, a shaft of a third wheel placed in a shaft hole in a main plate, elastic connection structures being rotated by a third-wheel shaft gear and a minute wheel piece gear which are engaged together and are arranged between a minute wheel tube and the minute wheel piece gear when a stem is pulled or the minute hand is adjusted through the handsetting wheel, the intermediate wheel and a minute wheel shaft gear, and a second-hand stop lever detachably connected to a second-hand stop electrode. The elastic connection structures are arranged between the minute wheel tube and the minute wheel piece gear, so that the quartz watch is accurate in travel time and has the function of efficiently adjusting the hour hand and the minute hand when omitting a handsetting middle wheel.

13 Claims, 7 Drawing Sheets

(56) References Cited

U.S. PATENT DOCUMENTS

| | | | | |
|---|---|---|---|---|
| 5,214,625 | A * | 5/1993 | Suzuki | G04C 3/007 368/185 |
| 6,179,464 | B1 * | 1/2001 | Bettelini | G04B 27/04 368/185 |
| 6,779,916 | B2 * | 8/2004 | Watanabe | G04C 9/00 368/190 |

* cited by examiner

QUARTZ WATCH MOVEMENT

CROSS REFERENCE OF RELATED APPLICATION

This is a non-provisional application that claims priority to international application number PCT/CN2014/072031, international filing date Feb. 13, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a quartz watch movement, and more particularly to a quartz watch movement which eliminates a clutch lever and a handsetting middle wheel.

Description of Related Arts

Quartz watches are popular because they have advantages of providing accurate time, having aesthetic appearance, and eliminating mechanical operations of the winding device for the mechanical watches. Since the quartz watch generally comprises a motor, a gear mechanism, and other circuit components installed inside a shell body, the inner space of the shell body is compacted. Therefore, many watch manufacturers try to improve the existing quartz by fully utilizing the limited space inside the quartz watch, reducing components inside the quartz watch, minimizing the abrasion on the watch movement parts, and developing more features of the quartz watch, as the major concerns in the R&D watch industries and as the development directions for the public, and especially for the development a second-hand stop clutch mechanism.

Referring to FIGS. 1, 3, 4, and 5, the conventional second-hand stop mechanism comprises a stem 7, a clutch lever 8, a second-hand stop electrode 82, a minute wheel 2, a second wheel 1, a third wheel 4, an intermediate wheel 5, a handsetting wheel 61, a main plate 92, a top plate 91, and a control circuit board. During the normal operation, the second wheel 2 is driven by an electric motor to transmit the power to the minute wheel 2 and the hour wheel through the third wheel 4, so as to drive the minute wheel 2 and the hour wheel to rotate. When adjusting the time of the quartz watch, the stem 7 is pulled out to move the clutch lever 8 to contact with the second-hand stop electrode 82. At the same time, the third wheel 4 is driven to move to disengage with the minute wheel 2 or the handsetting wheel 6 is driven to move to engage with the handsetting middle wheel 61. Meanwhile, the second wheel 1 is stopped to move by the motor. Accordingly, an outer handle end of the stem 7 can be rotated to rotate the minute wheel 2 through the handsetting wheel 6, the handsetting middle wheel 61, and the intermediate wheel 5, or through the handsetting wheel 6 and the intermediate wheel 5, to adjust the minute and hour wheels correspondingly.

Accordingly, the clutch lever 8 is actuated to perform two different operations in each actuation, i.e. to drive the rotation of the second wheel 1 and to engage the third wheel 4 with the minute wheel 2 (or to disengage the handsetting wheel 6 with the handsetting middle wheel 61), or to stop the rotation of the second wheel 1, and to disengage the third wheel 4 with the minute wheel 2 (or to engage the handsetting wheel 6 with the handsetting middle wheel 61).

There are two configurations for the existing second-hand stop clutch mechanisms.

1. The second-hand stop clutch mechanism without handsetting middle wheel:

Referring to FIGS. 1, 3, and 4 of the drawings, the piece gear of the third wheel 4 is meshed with the axis gear of the second wheel 1, and the axis gear of the third wheel 41 is meshed with the piece gear of the minute wheel 22, wherein an upper shaft portion of a shaft of the third wheel 4 is disposed inside a shaft hole of the top plate, and a lower shaft portion of the shaft of the third wheel 4 is disposed inside the shaft hole of the clutch lever. The second-hand arm 81 of the clutch lever 8 is connected to a front end of the stem 7, i.e. the winding stem, and the axis gear of the handsetting wheel 6 is meshed with the piece gear of the intermediate wheel 51, and the piece gear of the intermediate wheel 51 is meshed with the axis gear of the minute wheel 21, so that the axis gear of the minute wheel 2, the piece gear of the minute wheel 2, and the minute wheel tube 23 are connected with each other to form a whole clutch system.

During the normal operation, the stem 7 is arranged inside a shell body of the quartz watch, and a front end of the stem 7 is pressed against the second-hand stop arm 81 to force the clutch lever 8 being detached from the second-hand stop electrode 82. The second wheel 1 is driven to rotate by the motor, and the axis gear of the third wheel 41 is meshed with the piece gear of the minute wheel 22. At the same time, the power generated from the second wheel 1 is transmitted to the minute wheel and the hour wheel through the third wheel 4. When adjusting the time of the quartz watch, the stem 7 is pulled out, and then the front end of the stem 7 is coupled by a shaft sleeve of the handsetting wheel 6. So, the second-hand stop arm 81 is not supported by the front end of the stem 7 to displace the clutch lever 8. As a result, the second-hand stop arm 81 is contacted with the second-hand stop electrode 82. Under the control of the control circuit board, the second wheel 1 will be stopped to rotate by the motor, and at the same time, the clutch lever 8 will move to disengage the axis gear of the third wheel with the piece gear of the minute wheel 22. The outer handle of the stem 7 is then rotated to adjust the minute and the hour hand through the handsetting wheel 6, the intermediate wheel 5, and the minute wheel 2. Due to disengagement between the third wheel 4 and the minute wheel 2, the gears connected between the piece gear of the minute wheel 22 and the axis gear of the third wheel 41 will not be easily damaged by a resistance from the second wheel 1 while adjusting the time of the quartz watch.

2. The second-hand stop clutch mechanism with handsetting middle wheel:

Referring to FIGS. 1, 3, and 5 of the drawings, the piece gear of the third wheel 4 and the axis gear of the second wheel 1 are meshed with each other, and the axis gear of the third wheel 41 and the piece gear of the second wheel 22 are meshed with each other. An upper shaft portion of a shaft of the third wheel 4 is disposed inside a shaft hole of the top plate 91, and the lower shaft portion of the shaft of the third wheel 4 is disposed inside the shaft hole of the main plate 92. The clutch lever 8 and the handsetting wheel 6 are coupled on the stem 7. The axis gear of the handsetting wheel 6 is meshed with the piece gear of the handsetting middle wheel 61. The piece gear of the handsetting middle wheel 61 is meshed with the piece gear of the intermediate wheel 5. The piece gear of the intermediate wheel 51 is meshed with the axis gear of the minute wheel 1, so that the axis gear of the minute wheel 2 and the minute wheel tube 23 are connected with each other to form a whole clutch system. The minute wheel tube 23 and a minute wheel gear 3 are flexibly and rotatably connected with each other.

During the normal operation, the stem 7 is arranged inside the shell body of the quartz watch, and the clutch lever 8 is dis-connected with the second-hand stop electrode 82 to drive the handsetting wheel 6 being dis-meshed with the handsetting middle wheel 61, so that the second wheel 1 is driven to rotate by the motor. At the same time, the power generated from the second wheel 1 is transmitted to the piece wheel of the minute wheel 22 through the third wheel 4. Since the handsetting wheel 6 and the handsetting middle wheel 61 are not meshed with each other, the intermediate wheel 5 and the handsetting middle wheel 61 are connected with the axis gear of the minute wheel 2 under a low resistance condition. Since the minute wheel gear 3 and the minute wheel tube 23 are flexibly and rotatably connected with each other, the minute tube 23 is driven to rotate by the minute wheel gear 3 to active the normal operation for the minute hand and the hour hand under the flexibility property between the minute wheel gear 3 and the minute wheel tube 23. When adjusting the time of the quartz watch, the stem 7 is pulled out that the handsetting wheel 6 is moved by the clutch lever 8 to closely contact with the front end of the stem 7. At the same time, the axis gear of the handsetting wheel 6 and the piece gear of the handsetting middle wheel 61 are meshed with each other. The clutch lever 8 is then moved to link with the second-hand stop electrode 82. Under the control of the control circuit board, the second wheel 1 is not driven to rotate by the motor, and the outer handle of the stem 7 is rotated to transmit an adjusting energy to the minute wheel tube 23 through the handsetting wheel 6, the handsetting middle wheel 61, intermediate wheel 5, and the axis gear of the minute wheel 2. Since the minute wheel tube 23 and the minute wheel gear 3 are flexibly and rotatably linked with each other, and the piece gear of the minute wheel 22 and the axis gear of the third wheel 41 are meshed with each other, the minute wheel gear 3 is stopped by a resistance from the third wheel 4 and the second wheel 1 during the time adjusting of the quartz watch. The flexible force between the minute wheel gear 3 and the minute wheel tube 23 is overcome by the axis gear of the minute wheel 21 following by the rotation of the intermediate wheel 5, so as to drive the rotation of the minute and hour hand. Therefore, the connection portion between the piece gear of the minute wheel 22 and the axis gear of the third wheel 41 will not be damaged due to the resistance from the second wheel 1 after completing the time adjusting of the quartz watch.

The above mentioned second-hand stop clutch mechanisms have the following drawbacks:

1. In view of the first configuration of the second-hand stop clutch mechanism, the second-hand stop electrode 82 and the clutch lever 8 are contacted with each other via a touch contact, so that the second-hand stop electrode 82 will be polluted and oxidized after a period of time. In this situation, the electrical connectivity between the second-hand stop electrode 82 and the clutch lever 8 will gradually loss its function, and then the third wheel 4 will be moved inclinedly during the time adjustment of the quartz watch (while the stem 7 is pulled out, the lower shaft portion of the third wheel 4 will be inclined due to the displacement of the clutch lever 8). At the same time, the piece gear of the third wheel 4 and the axis gear of the second wheel 1 are meshed under an abnormal situation, so that the connection portion between the axis gear of the second wheel 1 and the piece gear of the third wheel 4 will be damaged by the non-stop rotation of the second wheel 1.

2. In view of the first' configuration of the second-hand stop clutch mechanism, the third wheel 4 will be inclined due to the displacement of the clutch lever 8 during the time adjustment of the quartz watch. After the time adjustment thereof, the third wheel 4 is re-engaged with the second wheel 1 and the minute wheel 2. During the long-time operation, the upper and lower shaft portions of the third wheel 4 will be deformed due to the frequency of the inclined operation of the third wheel 4, so as to decrease the reliable and time accuracy of the quartz watch.

3. In view of the second configuration of the second-hand stop clutch mechanism, the handsetting middle wheel 61 is installed between the handsetting wheel 6 and the intermediate wheel 5, so that the manufacturing cost of the quartz watch is increased.

4. In view of the first and second configurations of the second-hand stop clutch mechanisms, both of the first and second second-hand stop mechanisms require the clutch lever 8 for operation.

SUMMARY OF THE PRESENT INVENTION

The invention is advantageous in that it provides a quartz watch movement without a clutch lever and with high stability for the operation of the movement. The quartz watch movement does not require a clutch lever and is capable of improving the travel time reliability of a movement. A minute wheel of the quartz watch movement is connected to a handsetting wheel by an intermediate wheel in a transmission mode, a lower shaft tenon of a shaft of a third wheel penetrates through a space which omits an original clutch lever and is placed in a corresponding shaft hole in a main plate, elastic connection structures capable of relatively rotating by which a third-wheel shaft gear and a minute wheel piece gear which are engaged together and are in a static state are arranged between a minute wheel tube and the minute wheel piece gear when a winding stem is externally pulled or the minute hand is adjusted through the handsetting wheel, the intermediate wheel and a minute wheel shaft gear, a second-hand stop lever which can be connected to or disconnected from a second-hand stop electrode is arranged in front of the winding stem, a component omitting the clutch lever is used to guarantee that a clock is in an accurate engagement state among the second wheel, the third wheel and the minute wheel and improves the travel time reliability of the movement. Meanwhile, the elastic connection structures capable of relatively rotating are arranged between the minute wheel tube and the minute wheel piece gear, so that it is still guaranteed that the quartz watch is accurate in travel time and has the function of efficiently adjusting the hour hand and the minute hand in the case of omitting a handsetting middle wheel.

Additional advantages and features of the invention will become apparent from the description which follows, and may be realized by means of the instrumentalities and combinations particular point out in the appended claims.

According to the present invention, the foregoing and other objects and advantages are attained by a quartz watch movement, wherein the axis gear of the third wheel and the piece gear of the third wheel are meshed with the piece gear of the minute wheel and the axis gear of the second wheel respectively, and the axis gear of the minute wheel is meshed with the piece gear of the intermediate wheel, and then the piece gear of the intermediate wheel is meshed with the inner handle of stem, and the outer handle of the stem is coupled on the axis gear of the handsetting wheel orthogonally. The lower shaft of the third wheel is not placed inside a corresponding axis hole of the clutch lever based on the prior art, and the lower shaft of the third wheel is directly arranged on a corresponding axis hole of a main plate. The axis gear of the minute wheel and the minute wheel tube are rigidly linked with each other, and a lower end of the minute wheel tube is passed through a center hole of the minute wheel gear and a corresponding through hole of the main plate, so as to connect with the minute hand. While the minute wheel tube and the minute wheel gear are not operated under that the stem is pulled out to adjust the minute hand through the handsetting wheel, intermediate wheel, and the axis gear of the minute wheel, the axis gear of the third wheel and the piece gear of the minute wheel remain on a stop situation, wherein the axis gear of the third wheel and the piece gear of the minute wheel are flexibly and rotatably connected with each other. And, no clutch lever is provided on the front end of the stem to connect or dis-connect with the second-hand stop electrode.

The axis gear of the minute wheel, the minute wheel tube, and the minute wheel gear are made of metal. The shape-and-face connection structure comprises an outer cylindrical wall arranged on a root portion of the minute wheel tube and two metal and flexible retention members arranged on a center of the minute wheel gear, wherein the center hole is formed between the two retention members. The diameter of the outer cylindrical wall is larger than other portion of the minute wheel tube. The minute wheel gear comprises a disc portion having a plurality gears surrounding therearound, and each of the retention members comprises a circular arc portion and a straight margin portion, wherein the center hole is formed and surrounding by the circular arc portion, and the circular arc portion is linked with an inner edge of the disc portion through the straight margin portion. The inner edge from the circular arc portion and the straight margin portion to the disc portion has a cutout configuration.

The axis gear of the minute wheel and the minute wheel tube are made of metal, and the minute wheel gear is made of plastic. A cylindrical concave groove is arranged on the upper face of the minute wheel gear. The shape-and-face connection structure comprises the outer cylindrical wall arranged on a root portion of the minute wheel tube and a locking ring coupled inside the cylindrical concave groove, and the locking ring is made of metal, wherein the locking ring comprises a circle portion and two metal and flexible retention members, and each of metal and flexible retention members comprises a circular arc portion and a straight margin portion, wherein a circular hole is formed and surrounding by the circular arc portion and axially located at a location of the center hole, and the circular arc portion is linked with an inner edge of the circle portion through the straight margin portion. The inner edge from the circular arc portion and the straight margin portion to the circular ring portion has a cutout configuration.

The axis gear of the minute wheel and the minute wheel tube are made of metal, and the minute wheel gear is made of plastic. A cylindrical concave groove is arranged on the upper face of the minute wheel gear, and two position members are arranged on two sides of the center hole. The shape-and-face connection structure comprises the outer, cylindrical wall arranged on a root portion of the minute wheel tube and a locking ring coupled inside the cylindrical concave groove, and the locking ring is made of metal, wherein the locking ring comprises a circle portion and two metal and flexible retention members, and two position holes are arranged on the circle portions and located at corresponding positions of the position members. Each of metal and flexible retention members comprises a circular arc portion and a straight margin portion, wherein a circular hole is formed and surrounding by the circular arc portion and axially located at a location of the center hole, and the circular arc portion is linked with an inner edge of the circle portion through the straight margin portion. The inner edge from the circular arc portion and the straight margin, portion to the circular ring portion has a cutout configuration.

The second-hand stop shaft comprises an eccentric hole adapted to allow the front end of the stem being inserted therein and pulled out.

An outer wall of the front end of the stem comprises at least one guiding grooves to divide the outer wall thereof into at least two portions, wherein all of the side faces of the guiding groove are parallel with each other, and a sleeve is coupled on the front end of the stem to form a cylindrical surface, which are interference fitted.

The depth of the guiding groove is at least 0.3 mm, and the width of the guiding groove is at least 0.1 mm.

The axis gear of the minute wheel and the minute wheel tube are separately arranged, and axially and detachably connected with each other.

The axis gear of the minute wheel and the minute wheel tube are closely linked with each other.

A cyclic boss is arranged on a top platform of the minute wheel tube, wherein a circular hole of the minute wheel tube having the same internal diameter of the minute wheel tube is formed on a center portion of the cyclic boss, and the axis gear of the minute wheel comprises a ring-like through hole adapted to lock the cyclic boss into the ring-like through hole. Therefore, the cyclic boss and the ring-like through hole are closely linked with each other.

Comparing with the prior art, the present invention eliminates the clutch lever, and the lower shaft of the third wheel is arranged on the main plate, so that the third wheel will not frequently be inclined due to the displacement of the clutch lever, so as to maintain an accuracy meshing situation between the second wheel, the third wheel, and the minute wheel. In addition, the present invention is able to prevent that the damage between the upper and lower shaft of the third wheel with the inner wall of the axis hole while the upper and lower shaft of the third wheel are frequently inclined, so as to improve the stability of the operation of the movement. At the same time, the connection structure between the minute wheel tube and the minute wheel gear is a flexible and rotatable connection structure, so that no handsetting middle wheel is provided between the handsetting wheel and the intermediate wheel, so as to improve the efficiency for adjusting the minute and second hand of the quartz watch.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
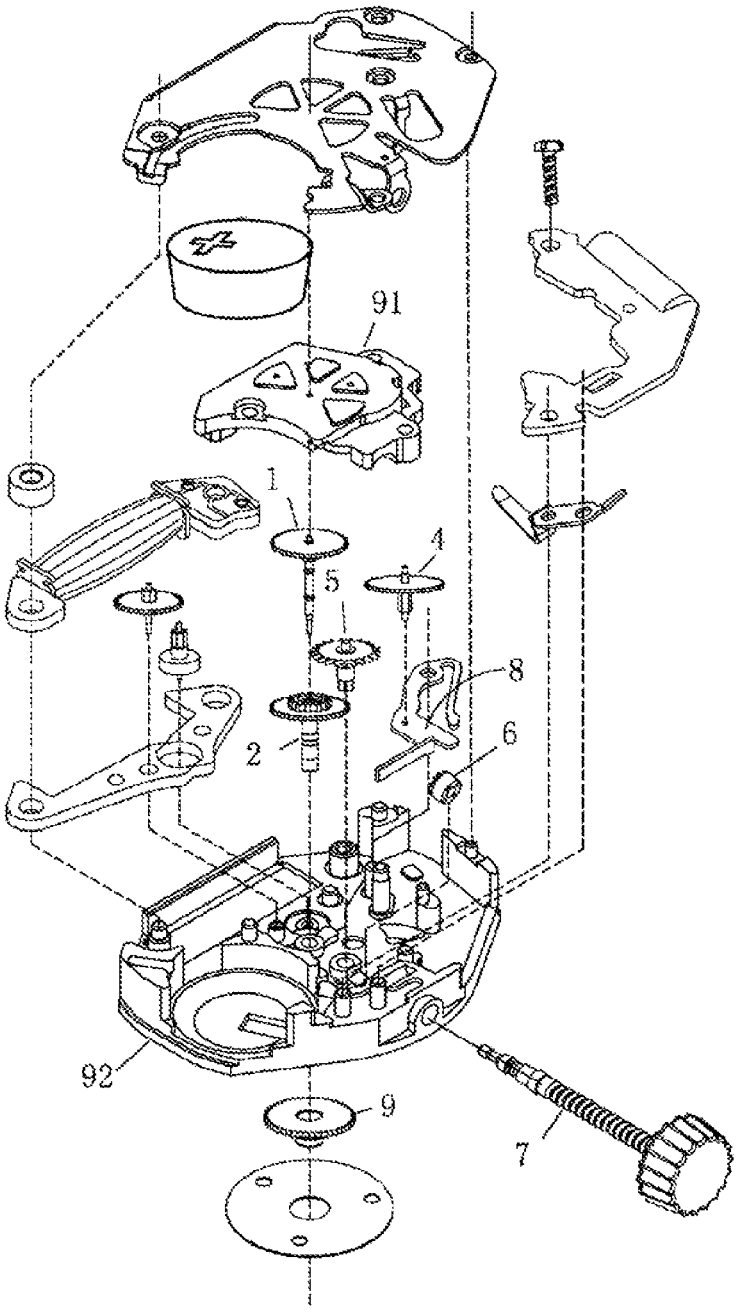
Fig. 1 Prior Art
FIG. 1 is an exploded perspective view of a conventional quartz watch movement.
Figure 2:
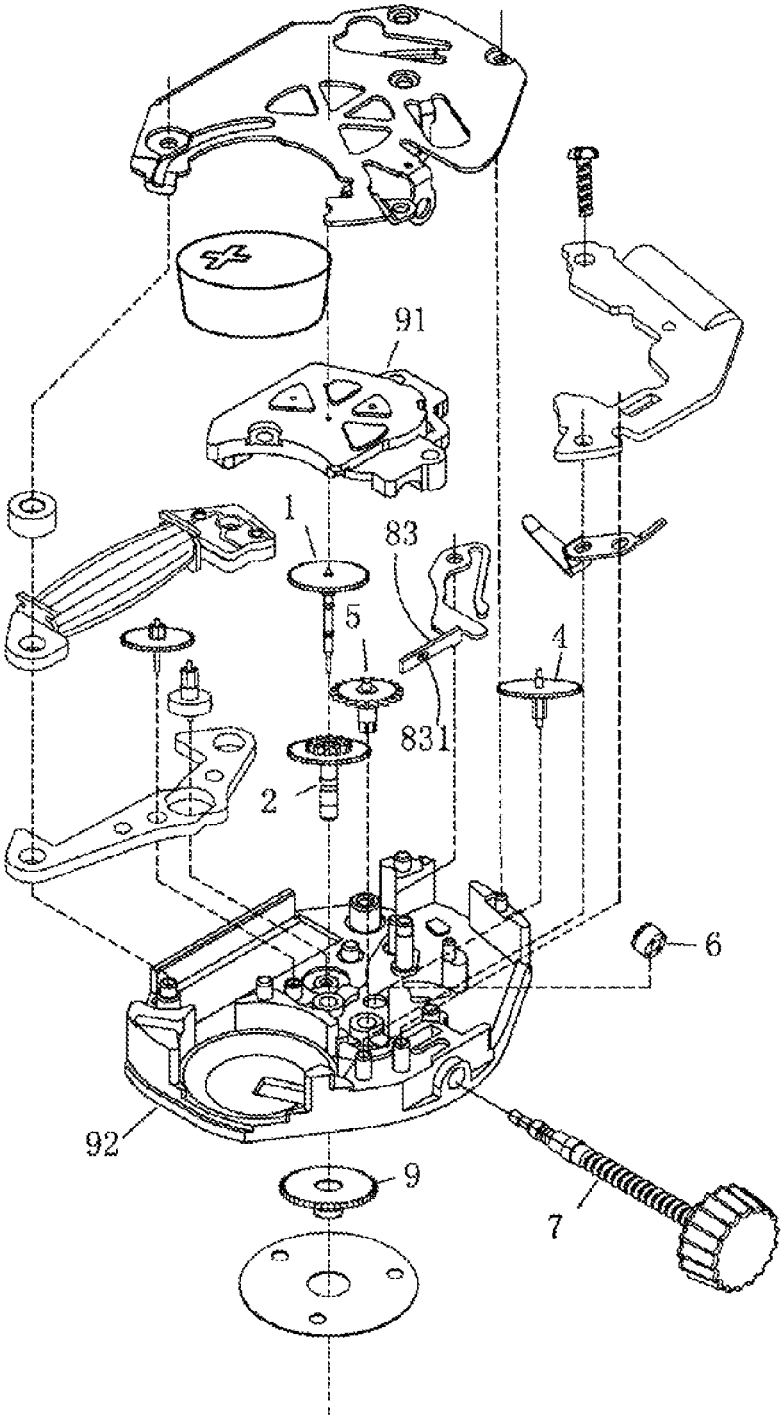
FIG. 2 is an exploded perspective view of the quartz watch movement according to a preferred embodiment of the present invention.
Figure 3:
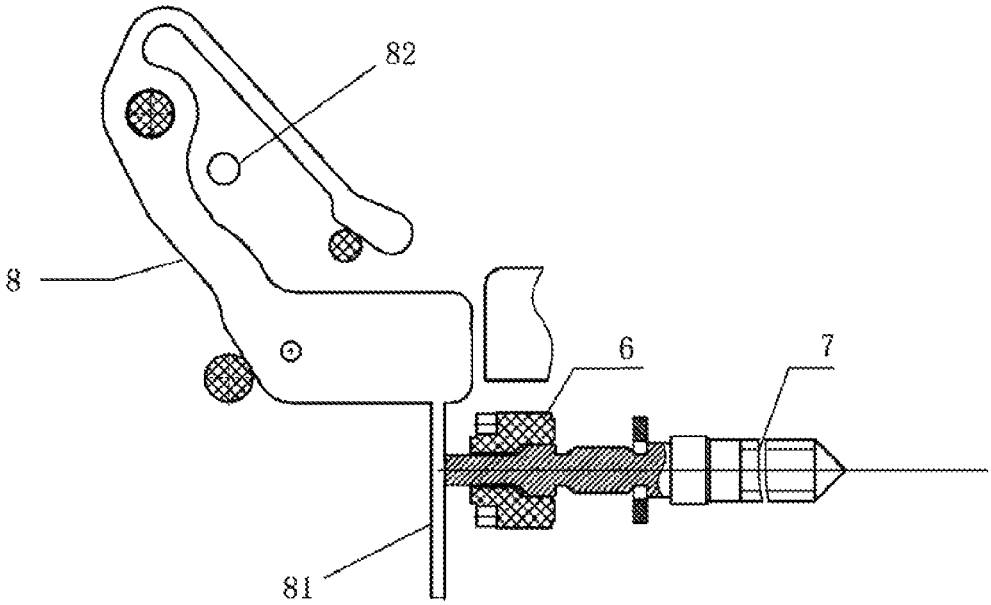
Fig. 3 Prior Art
FIG. 3 is side view of a second-hand stop clutch mechanism of the conventional quartz watch movement.
Figure 4:
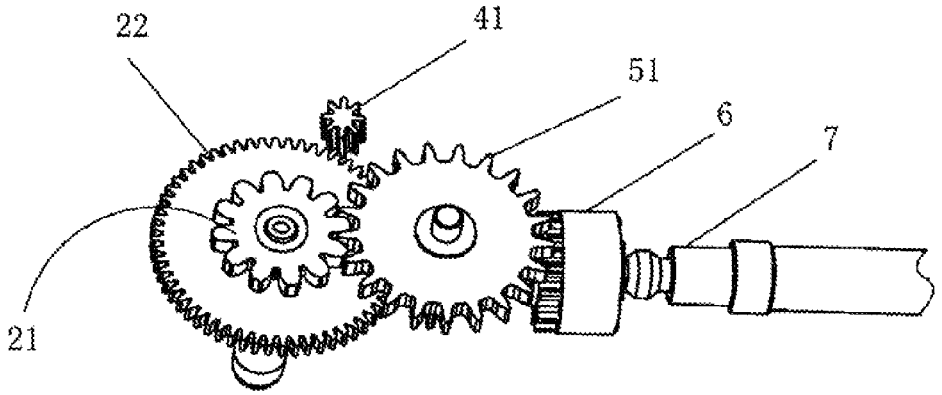
Fig. 4 Prior Art
FIG. 4 is a perspective view of the second-hand stop clutch mechanism of the conventional quartz watch movement.
Figure 5:
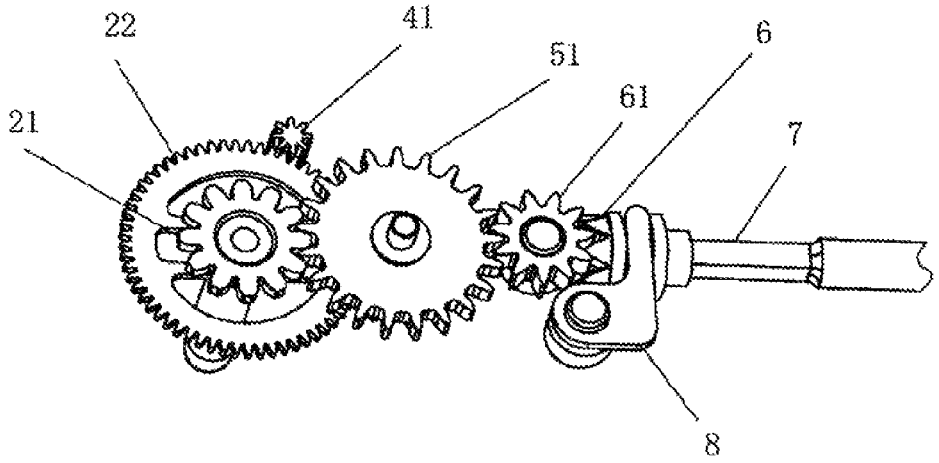
Fig. 5 Prior Art
FIG. 5 is a perspective view of another type of second-hand stop mechanism of the conventional quartz watch movement.

Referring to FIG. 2 of the drawings, a quartz watch movement according to a preferred embodiment of the present invention is illustrated, wherein the improvement of the quartz watch movement relates to a transmission structure among a second wheel 1, a third wheel 4, and a minute wheel 2, and a second-hand stop clutch mechanism.

During a normal operation, the engagement configuration of the second wheel 1, the third wheel 4, and the minute wheel 2 is the same as the conventional engagement configuration, wherein the axis gear of the third wheel 41 and the piece gear of the third wheel 4 are meshed with the piece gear of the minute wheel 22 and the minute wheel 1 respectively. After the activation of the motor, kinetic energy generated from the second wheel 1 is transmitted to the minute wheel 2 through the third wheel 4, so that the minute hand arranged below the minute wheel tube 23 is driven to rotate by the minute wheel 2.

According to the present invention, the axis gear of the minute wheel 21 is meshed with the piece gear of the intermediate wheel 51, and then the piece gear of the intermediate wheel 51 is meshed with the axis gear of the handsetting wheel 6 in an orthogonal axis manner (which is able to completely use an inner space inside the quartz watch). There is no handsetting middle wheel 61 arranged between the handsetting wheel 6 and the intermediate wheel 5 in the present invention, wherein the stem 7 is sleeved in the handsetting wheel 6, and the cross section of an inner section inside a sleeve of the handsetting wheel 6 is the same as that of a front end of the stem 7. The front end of the stem 7 can be a circle shape, a rectangular shape, a pentagon, or a trapezoid shape. While the stem 7 is pulled out, the front end of the stem 7 is placed inside the sleeve of the handsetting wheel 6. At the same time, when the stem 7 is rotated, the handsetting wheel 6 is driven to rotate via the rotation of the stem 7. While the stem 7 is pushed into the shell body to cause that the front end of the stem 7 is dis-meshed with the handsetting wheel 6, the stem 7 and the handsetting wheel 6 are flexibly and rotatably connected with each other. During the normal operation, the stem 7 is pushed inside the shell body of the quartz watch, and the front end of the stem 7 is disengaged with the sleeve of the handsetting wheel 6.

According to the present invention, the upper shaft of the third wheel 4 is arranged inside a corresponding axis hole of a top plate 91, and the lower shaft of the third wheel 4 is not placed inside a corresponding axis hole of the clutch lever 8. The lower shaft of the third wheel 4 is directly arranged on a corresponding axis hole of a main plate 92, so as to eliminate the arrangement of the clutch lever 8. That is to say, while the minute hand and the second hand are adjusted, the stem 7 is pulled out, so that the front end of the stem 7 is bounded by a second-hand stop shaft 83. Then the front end of the stem 7 is linked with the second-hand stop electrode 82, so that the second wheel is not driven to rotate by the motor. Therefore, the third wheel 4 will not be disengaged with the minute wheel 2, wherein the third wheel 4 is still engaged with the second wheel 1 and the minute wheel 2.

Figure 10:
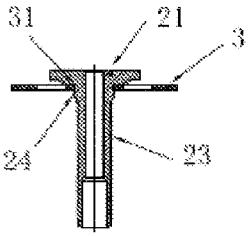
FIG. 10 is a sectional view of the quartz watch movement according to the above preferred embodiment of the present invention.

Referring to FIG. 2 and FIG. 10 of the drawings, the axis gear of the minute wheel 21 and the minute wheel tube 23 are rigidly linked with each other, and both of the axis gear of the minute wheel 21 and the minute wheel tube 23 are made of metal. A lower end of the minute wheel 23 passes through a center hole 31 of a minute wheel gear 3 and a corresponding through hole of the main plate 92 to connect with the minute hand, wherein the minute wheel tube 23 and the minute wheel gear 3 are flexibly and rotatably connected with each other.

The flexible and rotatable connection structure between the minute wheel tube 23 and the minute wheel gear 3 is that: the minute wheel tube 23 (the minute wheel tube 23 and the axis gear of the minute wheel 21 are fixedly connected with each other to form a one piece structure.) and the minute wheel gear 3 are two separate parts, and the minute wheel tube 23 is passed through the center hole 31 of the minute wheel gear 3, so that while the minute wheel tube 23 is rotated towards a certain direction (in the situation that the minute hand and the hour hand are adjusted) and the minute wheel gear 3 is stopped by the other transmission parts connected with the minute wheel gear 3 (the third wheel 4 meshed with the piece gear of the minute wheel 22 and the second wheel 4 meshed with the third wheel 4 are in a stop situation), the minute wheel tube 23 is able to overcome the flexible force between the minute wheel gear 3 and the minute wheel tube 23, so as to remain its original rotation direction. While the minute wheel gear 3 is rotated towards a certain direction (while the minute wheel gear 3 is operated in a normal situation) and the other transmission parts connected with the axis gear of the minute wheel 21 apply a small resistance force to the minute wheel gear 3 through the minute wheel tube 23 (the intermediate wheel 5 meshed with axis gear of the minute wheel 21 and the handsetting wheel 6 meshed with the intermediate wheel 5 are dismeshed with the stem 7, which can be determined as a non-resistance situation), the minute wheel tube 23 is driven to rotate towards the original direction by the flexibility force provided by the minute wheel gear 3.

The flexible and rotatable connection structure between the minute wheel tube 23 and the minute wheel gear 3 is able to achieve the following two functions:

First, during the normal operation of the quartz watch, the driving force provided from the motor is transmitted by the second wheel 1 to the minute wheel gear 3 through the third wheel 4, wherein the intermediate wheel 5 and the handsetting wheel 6 operatively connected with the axis gear of the minute wheel 21 have no rotation resistance therebetween since the stem 7 is disengaged with the handsetting wheel 6. According to the flexible and rotatably connection structure between the minute wheel tube 23 and the minute wheel gear 3, the minute wheel tube 23 is driven to rotate by the minute wheel gear 3 due to the flexible resistance between the minute wheel gear 3 and the minute wheel 23, so as to achieve the normal operation of the minute hand and the hour hand of the quartz watch.

Secondly, while the minute and hour hand of the quartz watch are adjusted, the stem 7 is pulled out to force the front end of the stem 7 to be meshed with the handsetting wheel 6, so that the front end of the stem 7 is bounded by a second-hand stop shaft 83, and then the second-hand stop shaft 83 is linked with the second-hand stop electrode 82, so that the second wheel 1 is stopped to rotate. In other words, the second wheel 1, the third wheel 4, and the minute wheel 2 are in the stop situation as well as that the second wheel 1, the third wheel 4, and the minute wheel 2 are meshed with each other. If the piece gear of the minute wheel 22, the axis gear of the minute wheel 21, and the minute wheel 23 are rigidly linked with each other, the axis gear of the minute wheel 21 is rotated to adjust the minute and hour hand of the quartz watch through the handsetting wheel 6 and the intermediate wheel 5, so that the meshed portions among the second wheel 1, the third wheel 4, and the minute wheel 2 are worn out easily. Since the minute wheel tube 23 and the minute wheel gear 3 are flexibly and rotatably connected with each other, it is able to prevent the damage problem of the meshed portions among the second wheel 1, the third wheel 4, and the minute wheel 2. That is to say, during the adjusting operation, the minute hand is driven to rotate by the axis gear of the minute wheel 2 since the axis gear of the minute wheel 2 is rotated by following the rotation the intermediate wheel 5, so as to overcome the flexible force applied on the minute wheel tube 23 by the minute wheel gear 3, and then the adjusting operation for the minute and hour hand is complete The second-hand stop shaft 83 of the present invention only provides a single second-hand stop function, so that there is no need to consider about the disengagement problem between the third wheel 4 and the minute wheel 2, or between the handsetting wheel 6 and the handsetting middle wheel 61, regarding to shape, connection method, and the installation position of the second-hand stop shaft 83 and the second-hand stop electrode 82. Therefore, the configurations for the second-hand stop shaft 83 and the second-hand stop electrode 82 are improved.

The second-hand stop shaft 83 has an eccentric hole 831 arranged to allow the front end of the stem 7 being inserted therein and pulled out, wherein the axial distance of the stem 7 is improved, so that different kinds of adjusting function can be achieved based on the axial distance of the stem 7. The eccentric hole 831 is arranged on the second-hand stop shaft 83 to allow the stem 7 being inserted into and pulled out. This structure improves the operation distance in an axial direction of the stem 7, so that different kinds of adjusting functions can be achieved by the operation distance of the stem 7.

In order to improve the strength between the stem 7 and the handsetting wheel 6 when they are engaged with each other and rotated, an outer wall of the front end of the stem 7 comprises a plurality of guiding grooves evenly and axially arranged thereon, and the front end of the inner sleeve of the handsetting wheel 6 comprises a plurality of matching racks arranged on positions corresponding to the positions of the guising grooves, so as to allow the matching racks being inserted into the guiding grooves. In other words, while the stem 7 is pulled out to adjust the minute and hour hand, the guiding grooves of the stem 7 are closely matched and engaged with the matching racks arranged on the inner sleeve of the handsetting wheel 6.

Generally, the stem 7 of the quartz watch is guided to pass through the sleeve of the handsetting wheel 6, and the cross section of the front end of the stem 7 and the sleeve of the handsetting wheel 6 are configured in circular shape, wherein the stem 7 and the sleeve of the handsetting wheel 6 are interference fitted. During the normal operation of the quartz watch, the stem 7 is pushed into the shell body of the quartz watch, and at the same time, the front end of the stem 7 is disengaged with the handsetting wheel 6, so that the handsetting wheel 6 is rotated with respect to the intermediate wheel 5. In other words, while adjusting the time of the quartz watch, the stem 7 is pulled out, and at the same time, the front end of the stem 7 is closely meshed with the sleeve of the handsetting wheel 6, so that the outer handle of the shaft of the stem 7 can be rotated to adjust the minute and hour hand through the handsetting wheel 6, intermediate wheel 5, and the minute wheel 2, so as to achieve the time adjusting function.

In the prior art, the front end of the stem 7 of the quartz watch is a solid cylinder shaft, so the design and process for the stem and the incorporation between the front end of the stem 7 and the sleeve of the handsetting wheel 6 have the following drawbacks:

1. Since the front end of the stem 7 and the sleeve of the handsetting wheel 6 are interference fitted with each other, the stem 7 is difficult to insert into and pull out from the sleeve of the handsetting wheel 6 during the adjusting operation of the quartz watch due to that the design and manufacturing error for the stem 7 and the handsetting wheel 6.

2. As for the interference fit between the stem 7 and the sleeve of the handsetting wheel 6, it is difficult to manufacture the stem 7 and the handsetting wheel 6 to perfectly match with each other, so that the costs for the labors, materials, and molds are highly increased.

Accordingly, the improvement of the present invention is to provide a connection structure between the stem 7 and handsetting wheel 6 with better transmission capability, large design margin, and low manufacturing cost. In the present invention, the front end of the stem 7 has a plurality of matching racks adapted to match and engage with the guiding grooves inside the sleeve of the handsetting wheel 6, so that the connection structure between the stem 7 and the handsetting wheel 6 is a "mold surface" connection or "profile connection", to replace the conventional cylindrical interference fit connection structure. Therefore, the "profile connection" connection structure improves the capability, the efficiency, the stability, and the accuracy of the transmission. In addition, the "profile connection" structure further improves the design margin of the sleeve of the handsetting wheel 6 and the stem 7, reduces the accuracy for the processing method thereof, simplifies the manufacturing technique of the stem 7, reduces the cost of the materials and labors, and improves the producing efficiency of the stem 7 and the handsetting wheel 6.

Figure 11:
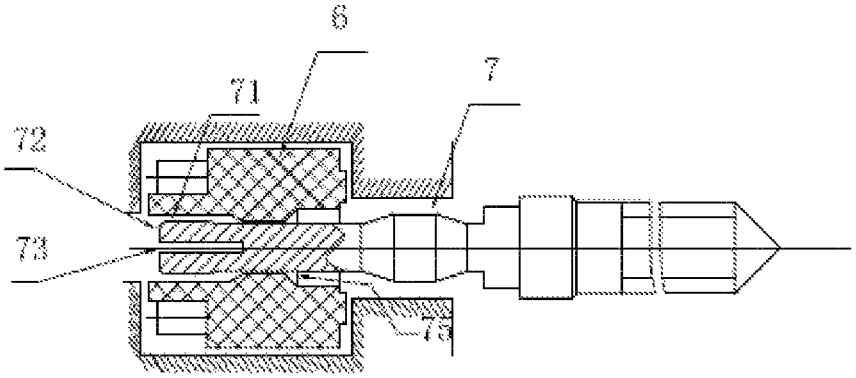
FIG. 11 is a cross sectional view of a connection structure between a stem and a sleeve of a handsetting wheel according to the above preferred embodiment of the present invention, illustrating the stem and the sleeve of the handsetting wheel not being linked with each other.

The followings are the concrete structure of the "profile connection" structure:

As shown in FIG. 11, the handsetting wheel 6 is preferably made of plastic, and the stem 7 is preferably made of metal materials, and the inner cross section of the sleeve 75 is formed in circular shape. The front end 71 of the cylindrical stem 7 comprises a linear shape guiding groove 73 formed towards the axial line direction of the stem 7, so that the stem 7 and the sleeve 75 are interference fits.

Figure 13:
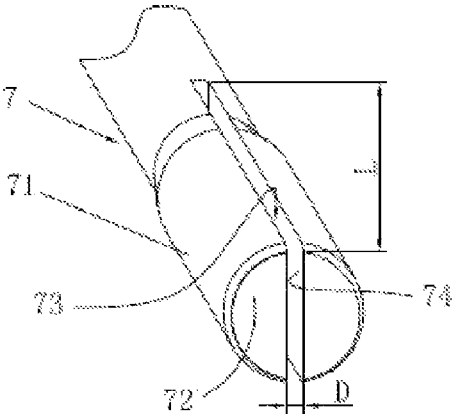
FIG. 13 is a perspective view of the stem according to the above preferred embodiment of the present invention, illustrating the stem comprising a guiding groove.

As shown in FIG. 13, the guiding groove 73, which is a liner and concave shape groove, runs through a front end surface 72 of the stem 7, wherein the depth L of the guiding groove 73 is between 0.3 mm-1.2 mm. Preferably, the depth L of the guiding groove 73 is 0.8 mm. The width D of the guiding groove 73 is between 0.1 mm-0.3 mm.

Preferably, the width D of the guiding groove 73 is 0.13 mm. In addition, a side surface 74 of the guiding groove 73 is perpendicular with the front end surface 72 of the stem 7. In other words, the guiding groove 73 is arranged on the front end surface 72 of the stem 7 to divide the front end surface 72 into two parts, and more than one guiding groove 73 can be arranged on the front end surface 72.

In order to achieve a further improvement of the present invention, when the depth L of the guiding groove 73 is larger than 1.2 mm, the two parts of the front end surface 72 of the stem 7 divided by the guiding groove 73 have better flexibility since the guiding groove 73 is squeezed by the sleeve of the handsetting wheel 6, which is made of the plastic materials. In the practical use, the depth L of the guiding groove is 1.6 mm.

As shown in FIG. 11, while the quartz watch is operated under the normal situation, the stem 7 is pushed into the shell body of the quartz watch, and the front end 71 of the stem 7 and the sleeve 75 of the handsetting wheel 6 is closely linked with each other (the front end 71 of the stem 7 is disposed inside a larger diameter portion of the sleeve 75). In this situation, while the outer shaft of the stem 7 is rotated, the handsetting wheel will not be rotated. At the same time, the cross section of the sleeve 75 of the handsetting wheel 6 is a circle shape 76 (as a dotted line, as shown in FIG. 14).

Figure 12:
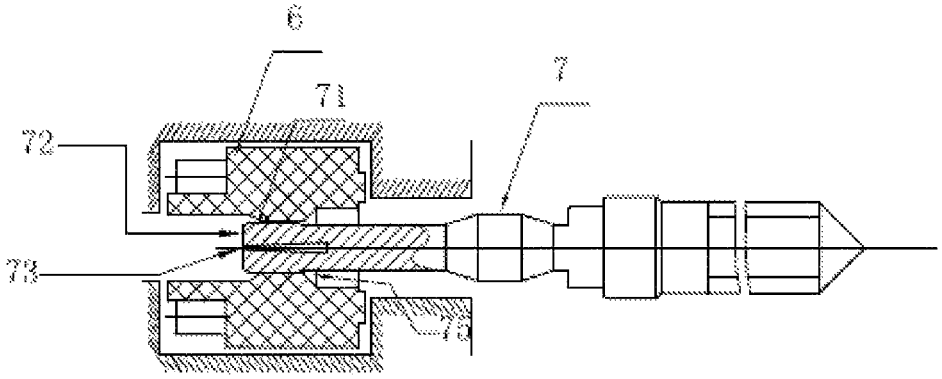
FIG. 12 is a sectional view of a connection structure between a stem and a sleeve of a handsetting wheel according to the above preferred embodiment of the present invention, illustrating the stem and the sleeve of the handsetting wheel being linked with each other.
Figure 14:
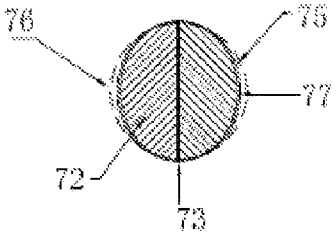
FIG. 14 is a sectional view of a shape change after the stem and the sleeve of the handsetting wheel according to the above preferred embodiment of the present invention, are coupled with each other.

Referring to FIG. 12 and FIG. 14 of the drawings, when the stem 7 is pulled out to adjust the time of the quartz watch, the front end 71 of the stem 7 is closely linked with the sleeve 75 of the handsetting wheel 6 (the front end 71 of the stem 7 is disposed inside a smaller diameter portion of the sleeve 75), such that the front end 71 of the stem 7 is interference fitted with the sleeve 75. In other words, the front end 71 of the stem 7 is exerted by a radial force by the sleeve 75 of the handsetting wheel 6, wherein the radial force is applied on the guiding groove 73 towards both horizontal and parallel directions, so as to cause different displacement for the front end 71 of the stem 7. The two different displacements of the front end 71 of the stems in the horizontal and parallel directions are disclosed as follows:

1. In the parallel direction of the guiding groove 73, the stem 7 has a rigid structure, so the diameter of the sleeve 75 of the handsetting wheel 6 is forced to increase.

2. In the horizontal direction of the guiding groove 73, since the guiding groove 73 is a clearance, the front end 71 of the stem 7 is subjected to a relative larger squeezing force under the flexibility property of the sleeve 75, the displacement of the front end 71 of the stem 7 is relative larger than in the parallel direction, so that the width of the clearance of the guiding groove 73 is getting narrow. Therefore, the two parts of the front end surface 72 of the 7 stem divided by the guiding groove 73 are moved closely to form an oval shape.

Accordingly, the connection structure between the stem 7 and the sleeve 75 is changed from the conventional cylindrical face connection structure into to oval shape 77 connection structure, which is the "profile connection" structure.

According to the "profile connection" structure, the axis hole has a non-circle cross section surface to transmit the torque, wherein the "profile connection" structure has advantages of the structure and the technique, and further can transmit a large torque. Therefore, the "profile connection" structure is widely applied in the mechanical transmission area.

The "profile connection" structure can highly improve the strength of the connection, decrease the manufacturing cost, simplify the manufacturing technique of the sleeve 75, and improve the incorporation allowance of the sleeve 75.

The stem 7 is made of flexible metal material. After the minute hand has been adjusted, the stem 7 is pushed into the shell body of the quartz watch to return its normal operation situation, and the front end 71 of the stem 7 is detached from the sleeve 75, so the front end 71 of the stem 7 outwardly applies a radial force since the front end 71 of the stem 7 doesn't be squeezed by the sleeve 75. At the same time, the guiding groove 73 remains to its original shape, and as well as that sleeve 75 will not be squeezed by the front end 71 of the stem 7. As a result, the sleeve 75 will return to its original shape due to the flexibility property of the sleeve 75.

Accordingly, while the front end 71 of the stem 7 is incorporated with the sleeve 75 of the handsetting wheel 6 at the first time, deformation may generate, wherein the deformation will not affect the "profile connection" structure for the front end 71 of the stem 7 and the sleeve 75 of the handsetting wheel 6 during the next time connection.

Embodiment 1

Figure 6:
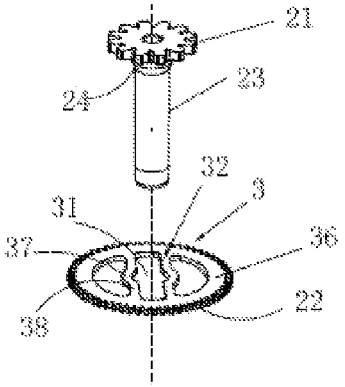
FIG. 6 is a perspective view of a first embodiment of a "profile connection" structure of the quartz watch movement according to the above preferred embodiment of the present invention.

Referring to FIG. 6 of the drawings, the axis gear of the minute wheel 21, the minute wheel tube 23, and the minute wheel gear 3 are made of metal. The "profile connection" structure comprises an outer cylindrical wall 24 arranged on a root portion of the minute wheel tube 23 and two metal and flexible retention members 32 arranged on a center of the minute wheel gear 3, wherein the center hole 31 is formed between the two retention members 32. The diameter of the outer cylindrical wall 24 is larger than other portion of the minute wheel tube 23, and the outer cylindrical wall 24 is placed inside the center hole 31, wherein the outer cylindrical wall 24 is flexibly and rotatably connected at the center hole 31. The minute wheel gear 3 comprises a disc portion 36 having a plurality gears surrounding therearound, and each of the retention members 32 comprises a circular arc portion 37 and a straight margin portion 38, wherein the center hole 31 is formed and surrounded by the circular arc portion 37, and the circular arc portion 37 is linked with an inner edge of the disc portion 36 through the straight margin portion 38. The inner edges from the circular arc portion 37 and the straight margin portion 38 to the disc portion 36 has a cutout configuration, so that the cutout configuration can provide more flexible space for the two flexible retention members 32.

Embodiment 2

Figure 7:
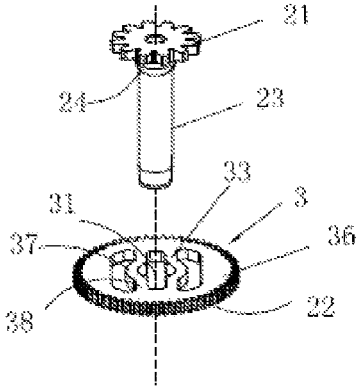
FIG. 7 illustrates a first alternative mode of the "profile connection" structure of the quartz watch movement according to the above preferred embodiment of the present invention.

Referring to FIG. 7 of the drawings, the axis gear of the minute wheel 21 and the minute wheel tube 23 are made of metal, and the minute wheel gear 3 is made of plastic. The "profile connection" structure comprises the outer cylindrical wall 24 arranged on a root portion of the minute wheel tube 23 and two plastic and flexible shafts 33 arranged on a center of the minute wheel gear 3, wherein the center hole 31 is formed between the two flexible shafts 33. Th diameter of the outer cylindrical wall 24 is larger than other portion of the minute wheel tube 23, and the outer cylindrical wall 24 is placed inside the center hole 31, wherein the outer cylindrical wall 24 is flexibly and rotatably connected with the center hole 31. The minute wheel gear 3 comprises a disc portion 36 having a plurality gears surrounding therearound, and each of the flexible shafts 33 comprises a circular arc portion 37 and a straight margin portion 38, wherein the center hole 31 is formed and surrounded by the circular arc portion 37, and the circular arc portion 37 is linked with an inner edge of the disc portion 36 through the straight margin portion 38. The inner edge from the circular arc portion 37 and the straight margin portion 38 to the disc portion 36 has a cutout configuration, so that the cutout configuration can provide more flexible space for the two plastic and flexible shafts 33.

The minute wheel 3 is made of plastic, which is able to reduce the cost of manufacturing instrument and materials, and the minute wheel gear 3 can be produced in enormous quantities by a specific mold.

Embodiment 3

Figure 8:
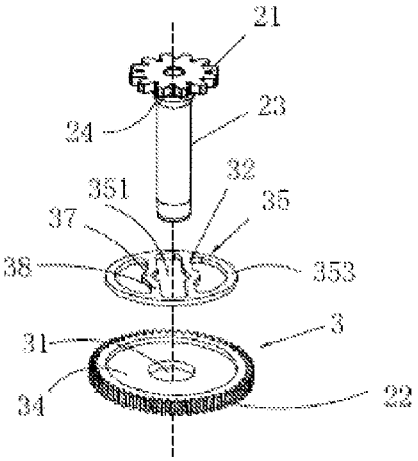
FIG. 8 illustrates a second alternative mode of the "profile connection" structure of the quartz watch movement according to the above preferred embodiment of the present invention.

Referring to FIG. 8 of the drawings, the axis gear of the minute wheel 21 and the minute wheel 23 are made of metal, and the minute wheel gear 3 is made of plastic. A cylindrical concave groove 34 is arranged on the upper face of the minute wheel gear 3. The "profile connection" structure comprises the outer cylindrical wall 24 arranged on a root portion of the minute wheel tube 23 and a locking ring 35 coupled inside the cylindrical concave groove 34, and the locking ring 35 is made of metal, wherein the locking ring 35 comprises a circular ring portion 353 and two metal and flexible retention members 32, and each of metal and flexible retention members 32 comprises a circular arc portion 37 and a straight margin portion 38, wherein a circular hole 351 is formed and surrounded by the circular arc portion 37 and axially located at a location of the center hole 31, and the circular arc portion 37 is linked with an inner edge of the circular ring portion 353 through the straight margin portion 38. The inner edge from the circular arc portion 37 and the straight margin portion 38 to the circular ring portion 353 has a cutout configuration, so that the cutout configuration can provide more flexible space for the two metal and flexible retention members 32. The diameter of the outer cylindrical wall 24 is larger than other portion of the minute wheel tube 23, and the outer cylindrical wall 24 is placed inside the circular hole 351, wherein the outer cylindrical wall 24 is flexibly and rotatably connected with the circular hole 351.

The minute wheel gear 3 is made of plastic, which has the same advantages as the embodiment 2, and the locking ring 35 is made of metal, so that the shape-and-face connection structure has larger stability.

Embodiment 4

Figure 9:
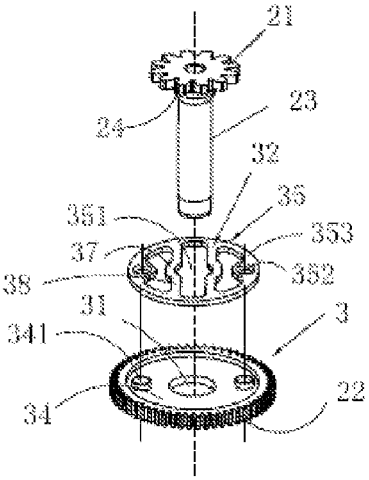
FIG. 9 illustrates a third alternative mode of the "profile connection" structure of the quartz watch movement according to the above preferred embodiment of the present invention.

Referring to FIG. 9 of the drawings, the axis gear of the minute wheel 21 and the minute wheel tube 23 are made of metal, and the minute wheel gear 3 is made of plastic. A cylindrical concave groove 34 is arranged on the upper face of the minute wheel gear 3, and two position members 341 are arranged on two sides of the center hole 31. The "profile connection" structure comprises the outer cylindrical wall 24 arranged on a root portion of the minute wheel tube 23 and a locking ring 35 coupled inside the cylindrical concave groove 34, and the locking ring 35 is made of metal, wherein the locking ring 35 comprises a circular ring portion 353 and two metal and flexible retention members 32, and two position holes 352 are spacedly arranged on the circular ring portion 353 and located at corresponding positions of the position members 341. Each of metal and flexible retention members 32 comprises a circular arc portion 37 and a straight margin portion 38, wherein a circular hole 351 is formed and surrounded by the circular arc portion 37 and axially located at a location of the center hole 31, and the circular arc portion 37 is linked with an inner edge of the circular ring portion 353 through the straight margin portion 38. The inner edge from the circular arc portion 37 and the straight margin portion 38 to the circular ring portion 353 has a cutout configuration, so that the cutout configuration can provide more flexible space for the two metal and flexible retention members 32. The diameter of the outer cylindrical wall 24 is larger than other portion of the minute wheel tube 23, and the outer cylindrical wall 24 is placed inside the circular hole 351, wherein the outer cylindrical wall 24 is flexibly and rotatably connected with the circular hole 351.

The minute wheel gear 3 is made of plastic, which has the same advantages as the embodiment 2, and the locking ring 35 is made of metal, so that the shape-and-face connection structure has larger stability.

As shown in FIG. 6 to FIG. 10 of the drawings, a minute wheel assembly (the minute wheel 2) comprises the minute wheel tube 23, made of metal, the axis gear of the minute wheel 21 arranged on a top portion of the minute wheel tube 23, the minute wheel gear, and the locking ring 35 placed into the concave portion of the minute wheel gear 3, wherein the minute wheel tube 23 and the axis gear of the minute wheel 21 is formed together (a minute wheel assembly), and the minute wheel assembly is small in size. Therefore, while the axis gear of the minute wheel 21 is processed, a gear hobbing machine is adapted for hobbing the metal material of the axis gear of the minute wheel 21 in a complicated technique and operation steps, wherein the gear hobbing machine has disadvantages of time-wasting, labor-wasting, and low efficiency. In addition, a lot of gear hobbing machines are needed to complete the processing of the axis gear of the minute wheel 21, so as to cause the high cost of investment and manufacturing. While the operators are unskilled, the low production rate will cause lots of waste.

Another improvement of the present invention is to provide a minute wheel tube assembly which is easy to manufacture, low in cost, and easy to assemble. The minute wheel tube assembly of the present invention is adapted to replace a whole of the minute wheel tube 23 and the axis gear of the minute wheel 21 into two individual members, which is that the minute wheel tube 23 and the axis gear of the minute wheel 21 are separately arranged and processed. And, the minute wheel tube 23 and the axis gear of the minute wheel 21 are fixedly assembled with each other by interference fits or the gluing method.

During the processing of the minute wheel tube 23 and the axis gear of the minute wheel 21, the axis gear of the minute wheel 21 is produced by a punching press method or an injection method, wherein the metal minute wheel tube 23 and the axis gear of the minute wheel, produced by the injection method, can be assembled together by the injection method. Accordingly, the manufacturing cost of the minute wheel tube assembly is relatively low, and no gear hobbing machine is needed during the processing method. In addition, the processing efficiency of the minute wheel assembly is improved, and the cost of the labor is largely decreased. The minute wheel tube 23 also can be processed by a traditional auto lathe processing, and then the minute wheel tube 23 and the axis gear of the minute wheel 21 is assembled by an automatic assembly machine.

The manufacturing cost of the minute wheel tube assembly is largely decreased.

The following is the concrete structure of the minute wheel tube assembly.

Figure 15:
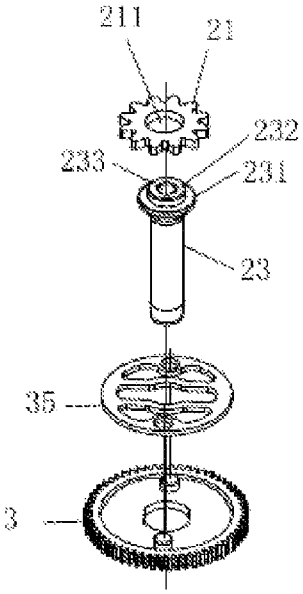
FIG. 15 is a perspective view of a minute wheel tube assembly according to the above preferred embodiment of the present invention.

Referring to FIG. 15 of the drawings, the minute wheel tube 23 and the axis gear of the minute wheel 23 are separately arranged, wherein the minute wheel tube 23 and the axis gear of the minute wheel 23 are axially and detachably connected, with each other, and the minute wheel gear 3 and the locking member 35 of the minute wheel are coupled on the minute wheel tube 23.

The improvement of the present invention is to provide an upwardly extending cyclic boss 232 on a top portion 231 of the minute wheel tube 23, wherein a circular hole of the minute wheel tube 233 having the same internal diameter of the minute wheel tube 23 is formed on a center portion of the cyclic boss 232. The cross section of an outer ring of the cyclic boss 232 is formed in a circular shape. While the processing method with easy in processing and low in cost is provided in the current mechanical processing area, the cross section of the outer ring of the cyclic boss 232 can be a polygon, such as quadrilateral, pentagon, or hexagon, wherein the polygon cyclic boss 232 has advantages for assembling the minute wheel tube 23 and the axis gear of the minute wheel 21; the axis gear of the minute wheel 21 comprises a ring-like through hole 211, arranged on a center of the axis gear of the minute wheel 21 and having the same size and shape of the cyclic boss 232, adapted to lock the cyclic boss 232 thereinto. The axis gear of the minute wheel 21 and the minute wheel tube 23 are connected with each other through the cyclic boss 232 being locking into the ring-like through hole 211. Preferably, the height of the cyclic boss 232 is the same as a top surface of the axis gear of the minute wheel 21.

Alternatively, a concave groove is arranged surrounding around the top platform 231 of the minute wheel tube 23, and a position boss arranged on a bottom surface of the axis gear of the minute wheel 21, having the same size and shape of the concave groove, is provided to lock into the concave groove. A circle through hole is arranged on a center of the position boss and extended from the position boss to the axis gear of the minute wheel 21, wherein the internal diameter of the circle through hole is the same as that of the minute wheel tube 23. While the processing method with easy in processing and low in cost is provided in the current mechanical processing area, the cross section of position boss can be a polygon, such as quadrilateral, pentagon, or hexagon, wherein the polygon position boss has advantages for assembling with the minute wheel tube 23 and the axis gear of the minute wheel 21.

During the normal operation and time adjusting operation of the quartz watch, the axis gear of the minute wheel 21 and the minute wheel tube 23 are required to be rotated at the same time, so that the minute wheel tube 23 and the axis gear of the minute wheel 21 are fixedly connected with each other. The minute wheel tube 23 and the axis gear of the minute wheel 21 are connected with each other by the following connection method:

1. The cyclic boss 232 and the ring-like through hole 211 are interference fitted, or the cyclic boss 23 are interference fitted with the concave groove.

2. The minute wheel tube 23 and the axis gear of the minute wheel 21 are glued with each other by superglue.

3. A fitting hole (not shown in the drawings) is arranged on a wall of the minute wheel tube 23 or a bottom disc of the axis gear of the minute wheel 21 by the high technical processing equipment, so that the minute wheel tube 23 and the axis gear of the minute wheel 21 can be fixedly connected with each other by a fitting pin.

4. The metal minute wheel tube 23 is placed into the injection machine, and then the metal minute wheel tube 23 and the axis gear of the minute wheel 21, produced by the injection method, can be fixedly assembled together by the injection method.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A quartz watch movement, comprising an axis gear of a third wheel meshed with a piece gear of a minute wheel, and a piece gear of said third wheel meshed with a second wheel, wherein an axis gear of said minute wheel is meshed with a piece gear of an intermediate wheel, and then said piece gear of the intermediate wheel is closely meshed with an axis gear of a handsetting wheel orthogonally, and a lower shaft of said third wheel is directly arranged inside a corresponding axis hole of a main plate without having a clutch lever, wherein said minute wheel and said axis gear of said minute wheel are rigidly linked with each other, and a lower end of said minute wheel is passed through a center hole of a minute wheel gear and a corresponding through hole of said main plate, end while a minute wheel tube and said minute wheel gear are not operated under that a stem is pulled out to adjust a minute hand through said handsetting wheel, said intermediate wheel, and said axis gear of said minute wheel, said axis gear of said third wheel and said piece gear of said minute wheel remain in a stop situation, wherein said axis gear of said third wheel and a piece gear of said minute wheel are flexibly and rotatably connected with each other, and no clutch lever is provided on a front end of said stem to connect or dis-connect with a second-hand stop electrode.

2. The quartz watch movement, as recited in claim 1, wherein said axis gear of said minute wheel, said minute wheel tube, and said minute wheel gear are made of metal, wherein a "profile connection" structure comprises an outer cylindrical wall arranged on a root portion of said minute wheel tube and two metal and flexible retention members arranged on a center of said minute wheel gear, and a center hole is formed between said two retention members, wherein a diameter of said outer cylindrical wall is larger than other portion of said minute wheel tube, and said minute wheel gear comprises a disc portion having a plurality of gears surrounding therearound, and each of said retention members comprises a circular arc portion and a straight margin portion, wherein said center hole is formed and surrounded by said circular arc portion, and said circular arc portion is linked with an inner edge of the disc portion through said straight margin portion, and an inner edge of from said circular arc portion and said straight margin portion to said disc portion has a cutout configuration.

3. The quartz watch movement, as recited in claim 1, wherein said axis gear of said minute wheel and said minute wheel tube are made of metals, and a minute wheel gear is made of plastic, and a cylindrical concave groove is arranged on an upper face of said minute wheel gear, wherein a "profile connection" structure comprises an outer cylindrical wall arranged on a root portion of said minute wheel tube and a locking ring coupled inside said cylindrical concave groove, and said locking ring is made of metal, wherein said locking ring comprises a circle portion and two metal and flexible retention members, and each of said metal and flexible retention members comprises a circular arc portion and a straight margin portion, wherein a circular hole is formed and surrounded by said circular arc portion and axially located at a location of a center hole, and said circular arc portion is linked with an inner edge of said circle portion through said straight margin portion, and an inner edge from said circular arc portion and said straight margin portion to said circular ring portion has a cutout configuration.

4. The quartz watch, as recited in claim 1, wherein said axis gear of said minute wheel and said minute wheel tube are made of metal, and a minute wheel gear is made of plastic, and a cylindrical concave groove is arranged on an upper face of said minute wheel gear, and two position members are arranged on two sides of a center hole, wherein a "profile connection" structure comprises an outer cylindrical wall arranged on a root portion of a minute wheel tube and a locking ring coupled inside said cylindrical concave groove, and said locking ring is made of metal, wherein said locking ring comprises a circle portion and two metal and flexible retention members, and two position holes are arranged on said circle portions and located at corresponding positions of said position members, and each of metal and flexible retention members comprises a circular arc portion and a straight margin portion, wherein a circular hole is formed and surrounded by said circular arc portion and axially located at a location of said center hole, and said circular arc portion is linked with an inner edge of said circle portion through said straight margin portion, and an inner edge from said circular arc portion and said straight margin portion to said circular ring portion has a cutout configuration.

5. The quartz watch movement, as recited in claim 1, wherein said second-hand stop electrode is linked with a second-hand stop shaft which comprises an eccentric hole adapted to allow the front end of said stem being inserted therein and pulled out.

6. The quartz watch movement, as recited in claim 1, wherein an outer wall of a front end of said stem comprises at least one guiding grooves to divide said outer wall into at least two parts, wherein all of the side face of said guiding grooves are parallel with each other, and a sleeve is coupled on said front end of said stem to form a cylindrical surface, which are interference fitted.

7. The quartz watch movement, as recited in claim 6, wherein a depth of said guiding groove is at least 0.3 mm and a width of said guiding groove is at least 0.1 mm.

8. The quartz watch movement, as recited in claim 1, wherein said axis gear of said minute wheel and said minute wheel tube are separately arranged, and axially and detachably connected with each other.

9. The quartz watch movement, as recited in claim 1, wherein said axis gear of said minute wheel and said minute wheel tube are closely linked with each other.

10. The quartz watch movement, as recited in claim 9, wherein a cyclic boss is arranged on a top platform of said minute wheel tube, wherein a circular hole of said minute wheel tube having the same internal diameter of said minute wheel tube is formed on a center portion of said cyclic boss, and said axis gear of said minute wheel comprises a ring-like through hole adapted to lock said cyclic boss into a ring-like through hole, and said cyclic boss and said ring-like through hole are closely linked with each other.

11. The quartz watch movement, as recited in claim 2, wherein said second-hand stop electrode is linked with a second-hand stop shaft which comprises an eccentric hose adapted to allow the front end of said stem being inserted therein and pulled out.

12. The quartz watch movement, as recited in claim 3, wherein said second-hand stop electrode is linked with a second-hand stop shaft which comprises an eccentric hole adapted to allow the front end of said stem being inserted therein and pulled out.

13. The quartz watch movement, as recited in claim 4, wherein said second-hand stop electrode is linked with a second-hand stop shaft which comprises an eccentric hole adapted to allow the front end of said stem being inserted therein and pulled out.

* * * * *